US010994961B2

(12) United States Patent
Secchiari

(10) Patent No.: US 10,994,961 B2
(45) Date of Patent: May 4, 2021

(54) DEVICE FOR FEEDING AND ACCUMULATING FILM MADE OF PLASTIC MATERIAL

(71) Applicant: SICA S.P.A., Alfonsine (IT)

(72) Inventor: Marco Secchiari, Alfonsine (IT)

(73) Assignee: SICA S.P.A., Alfonsine (IT)

( * ) Notice: Subject to any disclaimer, the term of this patent is extended or adjusted under 35 U.S.C. 154(b) by 147 days.

(21) Appl. No.: 16/085,411

(22) PCT Filed: Apr. 3, 2017

(86) PCT No.: PCT/IB2017/051891
§ 371 (c)(1),
(2) Date: Sep. 14, 2018

(87) PCT Pub. No.: WO2017/175112
PCT Pub. Date: Oct. 12, 2017

(65) Prior Publication Data

US 2019/0084785 A1 Mar. 21, 2019

(30) Foreign Application Priority Data

Apr. 8, 2016 (IT) ..... 102016000036527

(51) Int. Cl.
*B65H 20/34* (2006.01)
*B65B 41/12* (2006.01)

(52) U.S. Cl.
CPC ..... *B65H 20/34* (2013.01); *B65B 41/12* (2013.01); *B65H 2403/51* (2013.01); *B65H 2408/2171* (2013.01); *B65H 2515/31* (2013.01)

(58) Field of Classification Search
CPC ..... B25H 20/34; B65B 41/12; B65H 2408/2171; B65H 2515/31
(Continued)

(56) References Cited

U.S. PATENT DOCUMENTS 3,669,375 A * 6/1972 Bruton ..... D06B 17/06 242/417.2
4,406,251 A 9/1983 Neri et al.
(Continued)

FOREIGN PATENT DOCUMENTS

DE 3727339 A1 3/1989
EP 1950138 A1 7/2008

OTHER PUBLICATIONS

International Search Report and Written Opinion dated Jun. 12, 2017 for counterpart PCT Application No. PCT/IB2017/051891.
(Continued)

*Primary Examiner* — Robert F Long
*Assistant Examiner* — Xavier A Madison
(74) *Attorney, Agent, or Firm* — Shuttleworth & Ingersoll, PLC; Timothy Klima

(57) ABSTRACT

Described is a device for feeding and accumulating film (2) made of plastic material wound on a reel to a bagging machine (4), comprising a frame (9), means for supporting at least one reel (3) of film (2) made of plastic material supported by the frame (9), a first and a second group (G1, G2) of rollers for redirecting the film (2) made of plastic material, the rollers of the first and second group (G1, G2) being arranged in two respective rows parallel to each other, the film (2) being designed to be wound alternatively on the rollers of the two groups (G1, G2) forming a plurality of loops.

8 Claims, 5 Drawing Sheets

(58) Field of Classification Search
USPC ..... 53/570; 226/11
See application file for complete search history.

(56) References Cited

U.S. PATENT DOCUMENTS

| | | | | | |
|---|---|---|---|---|---|
| 4,543,152 | A * | 9/1985 | Nozaka | B65H 19/102 | 156/157 |
| 4,856,692 | A * | 8/1989 | Harper | B65B 41/16 | 226/11 |
| 5,810,236 | A * | 9/1998 | Yoshida | B65H 20/34 | 226/118.3 |
| 7,934,361 | B2 * | 5/2011 | Tsuruta | B65B 9/20 | 53/451 |
| 2005/0061846 | A1 * | 3/2005 | Seaberg | B65H 19/14 | 226/118.3 |

OTHER PUBLICATIONS

Italian Search Report dated Dec. 6, 2016 for counterpart Italian Patent Application No. IT UA20162434.

* cited by examiner

DEVICE FOR FEEDING AND ACCUMULATING FILM MADE OF PLASTIC MATERIAL

TECHNICAL FIELD

This invention relates to a device for feeding and accumulating film made of plastic material.

More specifically, this invention relates to a device for feeding a film made of plastic material, wound on reels, to a bagging machine, and accumulation of a certain quantity of the film, to be used in order to guarantee a practical replacement of the reels.

BACKGROUND ART

Machines for bagging or wrapping products are used in many industrial sectors and these machines require units for feeding film which will form, in predetermined pieces, the wrapper of the products themselves.

The most practical and commonly used form for storing film made of plastic material without doubt consists of reels or rollers on which the film is wound on itself.

A problem often felt is connected to the passage from a reel which is nearly empty to a new reel.

In the particular technical field in which the Applicant operates, that of the production of pipes made of plastic material for supplying or draining liquids, sections of pipe, either individual or multiple sections, of predetermined length, are bagged at a packaging station, by covering with film made of plastic material.

The above-mentioned packaging station therefore normally comprises a bagging machine to which the pipes to be packaged are fed, and a device for feeding film made of plastic material.

Currently, when the reel of film which supplies the bagging machine is nearly finished, an operator stops the bagging machine, replaces the reel nearly empty with a new one and splices the end of the film nearly finished with the top of the film emerging from the new reel. Only after carrying out in sequence all these operations can the operator restart the machine, with obvious affects on the overall efficiency of the production line.

DISCLOSURE OF THE INVENTION

The aim of this invention is to overcome the above mentioned drawbacks of the prior art by means of a device for feeding and accumulating film made of plastic material which is functional and practical to use.

The technical features of the invention according to the above-mentioned objects may be easily inferred from the contents of the appended claims, especially claim 1, and, preferably, any of the claims that depend, either directly or indirectly, on this claim.

BRIEF DESCRIPTION OF DRAWINGS

The advantages of the invention will become more apparent from the detailed description which follows, with reference to the accompanying drawings which illustrate preferred embodiments of the invention provided merely by way of example without restricting the scope of the inventive concept, and in which.

DETAILED DESCRIPTION OF PREFERRED EMBODIMENTS OF THE INVENTION

With reference to the accompanying drawings, the numeral 1 denotes in its entirety a device for feeding and accumulating a film 2 made of plastic material made in accordance with this invention.

The film 2 made of plastic material is wrapped on reels 3 of known type.

Figure 1:
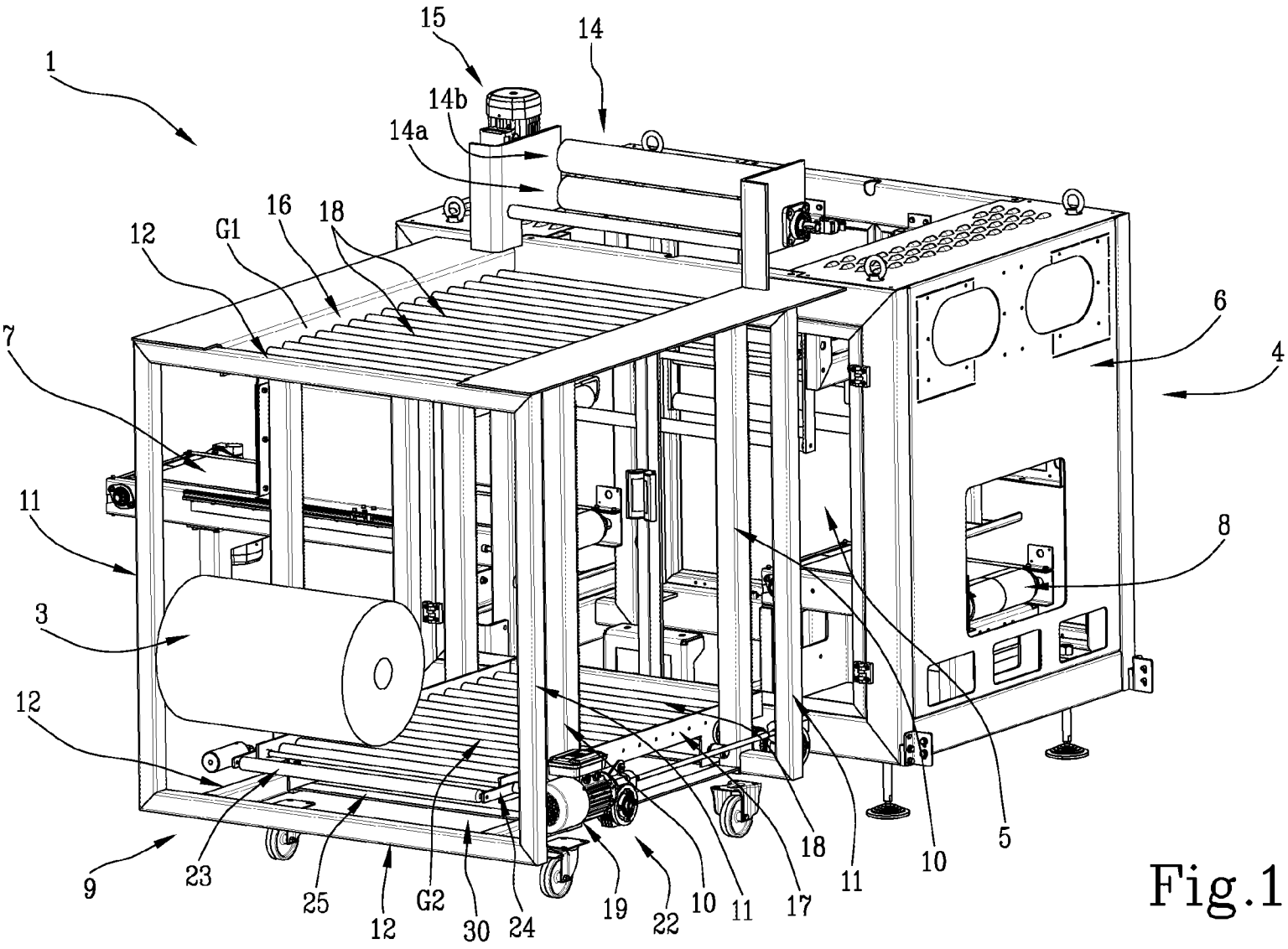
FIG. 1 is a schematic perspective view of a preferred embodiment of the device for feeding and accumulating film according to the invention combined with a bagging machine.

As illustrated in FIG. 1, the device 1 feeds and accumulates film 2 made of plastic material to a bagging machine 4.

For example, the bagging machine 4 is used for packaging pieces of pipe made of plastic material, not illustrated, and it is inserted in a production system, at the end of a respective line for feeding these pieces of pipe; the above-mentioned production line and system not being illustrated.

With reference to FIG. 1, the bagging machine 4 comprises an operational unit 5, partially closed by a respective casing 6.

The pieces of pipe, not illustrated, are fed to the operating unit 5, by means of a first conveyor belt 7 and, once packaged in relative bags, also not illustrated, they are discharged by means of a second conveyor belt 8.

Figure 2:
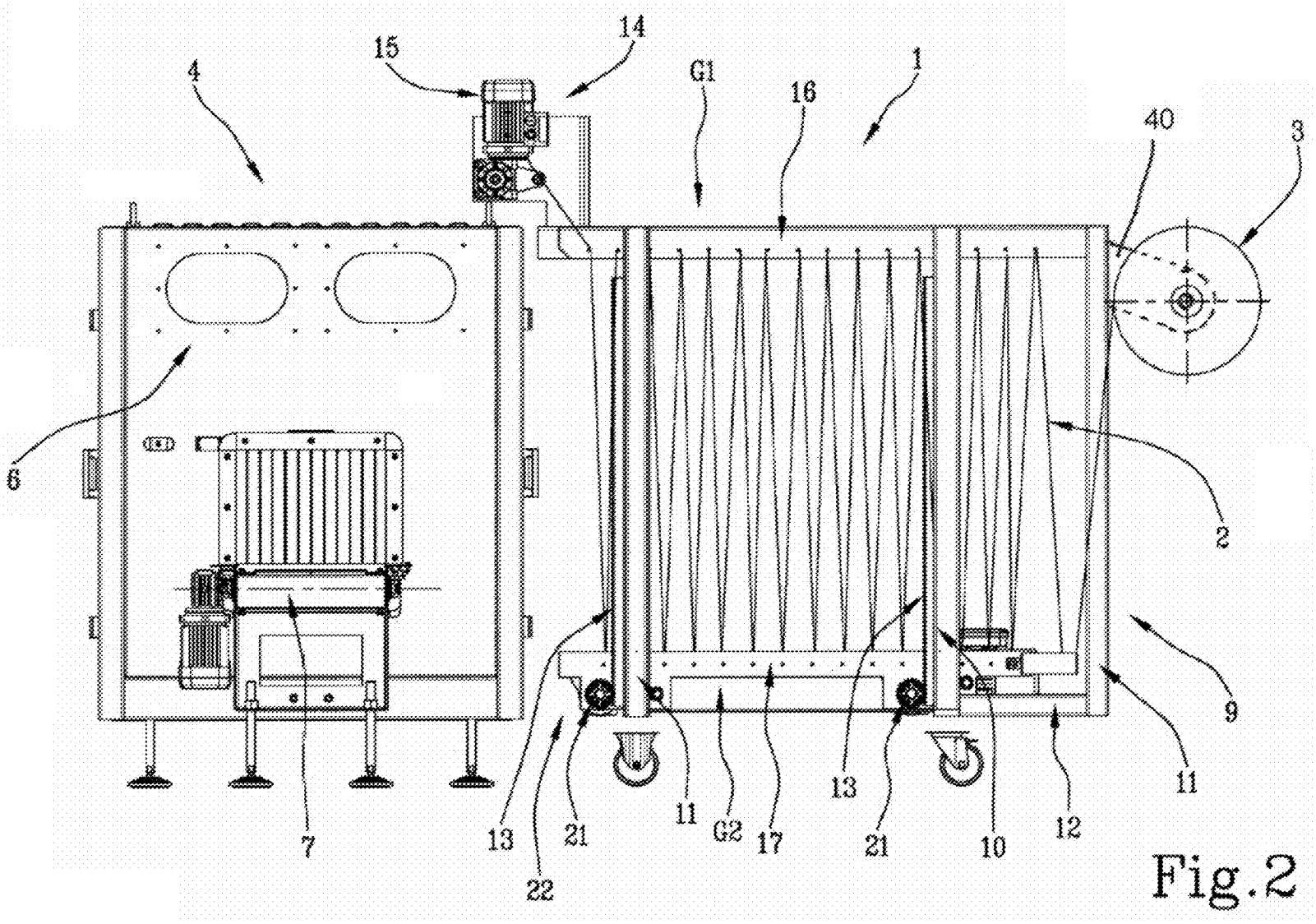
FIGS. 2 and 3 are respective schematic side elevation views of the device of FIG. 1 in two different configurations of use.
Figure 3:
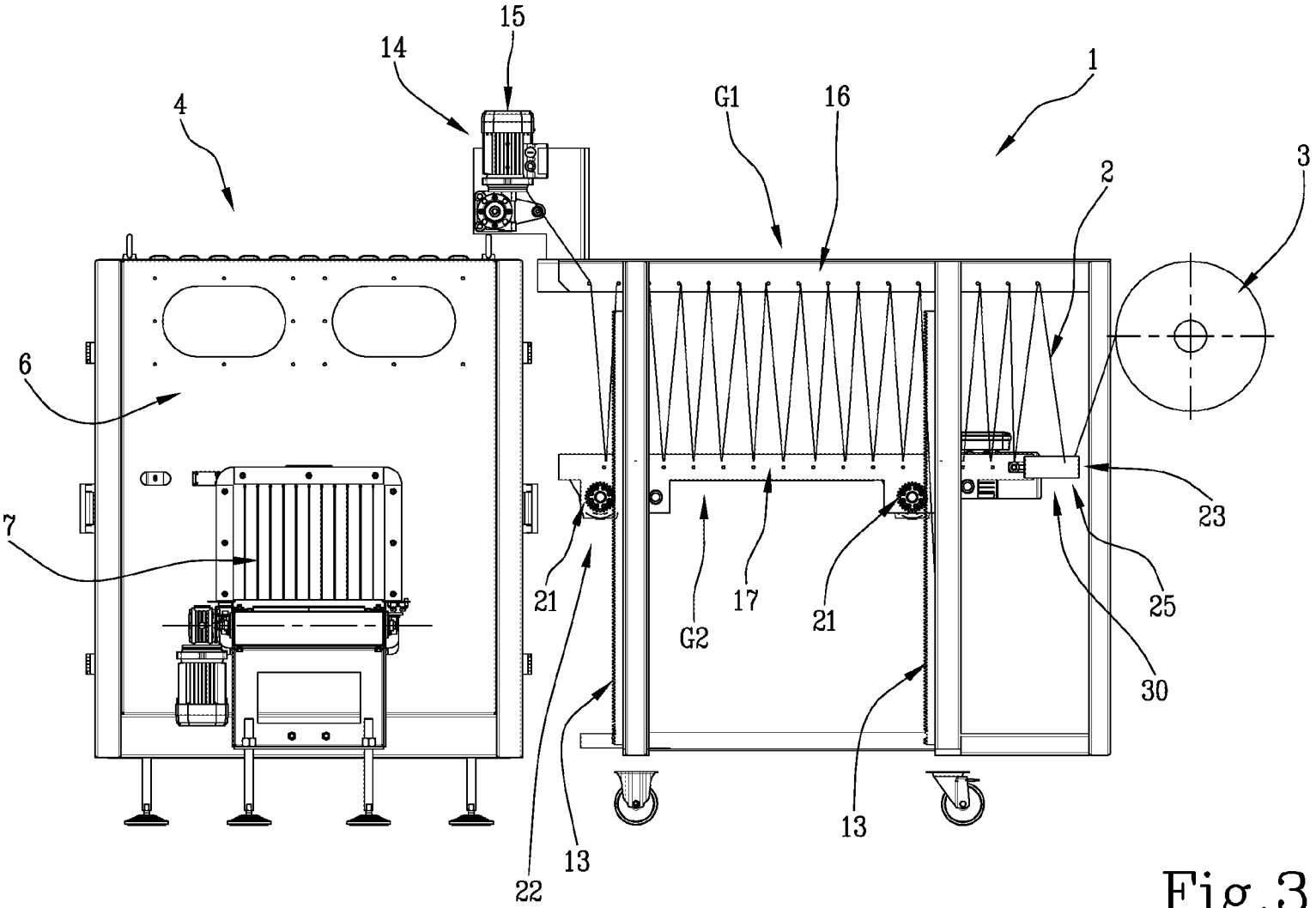

As illustrated in FIGS. 1 to 3, the feeding and accumulating device 1 comprises a frame 9.

The frame 9 comprises four inner uprights 10 the four outer uprights 11, which are stably connected together by means of a plurality of crosspieces 12.

On the inner uprights 10 are positioned, extending longitudinally and parallel to them, respective racks 13.

The device 1 also comprises a reel mount 40, a reel mount 40 for supporting reels 3 of film 2. See FIG. 2.

At its top, the device 1 has a unit 14 for drawing the film 2 made of plastic material.

Again on the top of the device 1, there are, not illustrated, means for splicing the ends of the film 2 made of plastic material.

The unit 14, of substantially known type, comprises two rollers 14*a*, 14*b* of which one motorised by an electric motor 15.

The unit 14 is designed to feed the film 2 to the bagging machine 4, unwinding it from the respective reel 3.

Again with reference to FIGS. 1 to 3, the device 1 comprises two roller conveyors 16, 17, respectively upper and lower, for supporting a plurality of rollers 18 for redirecting the film 2 made of plastic material.

The rollers 18 of each roller conveyor 16, 17 are positioned in succession and coplanar with each other.

The rollers 18 of the above-mentioned upper and lower roller conveyors 16, 17, respectively define a first G1 and a second G2 group of rollers.

Basically, the rollers 18 of the above-mentioned first and second group G1, G2 are positioned in two respective rows parallel to each other, the film 2 being designed to be wound alternatively on the rollers 18 of the two groups G1, G2, forming a coil or a plurality of loops.

As illustrated in FIGS. 2 and 3, the upper roller conveyor 16 is fixed relative to the frame 9 whilst the lower roller conveyor 17 is movable relative to the frame 9 in a direction vertical to the ground and substantially coincident with the longitudinal extension of the uprights 10 and 11.

During its movement towards/away from the upper roller conveyor 16, the lower roller conveyor 17 remains parallel to itself.

With reference to FIGS. 1 and 2, the device 1 comprises an electric motor 19 supported by the lower roller conveyor 17 which, by means of suitable motion transmission means 20, is designed to rotate four gear wheels 21 which each mesh on a respective rack 13.

The above-mentioned racks 13, gear wheels 21, electric motor 19 and motion transmission means 20 together define, for the device 1, respective means 22 for relative movement of the first and second group G1, G2 of rollers 18.

According to a preferred variant embodiment not illustrated, the movement means 22 comprise, in an alternative to the racks and gear wheels, respective lead nut and screw couplings. In this variant, not illustrated, the means 20 for transmitting the motion rotate a plurality of threaded rods which extend parallel to the uprights 10 and engage by screwing in respective threaded holes integral with the lower movable roller conveyor 17. According to this variant, the electric motor 19, the transmission means 20 and the threaded rods are supported by the frame 9 and not by the movable roller conveyor 17.

The variation of the distance of the two groups G1, G2, that is to say, of the two roller conveyors 16, 17 causes a simultaneous variation of the extension of the above-mentioned loops of the film 2 wound on the rollers 18.

Consequently, the variation in the extension of the loops coincides with a variation of the length of the film 2 made of plastic material wound between the rollers of the two roller conveyors 16, 17.

As illustrated in the accompanying drawings, the device 1 comprises a first roller 23 for redirecting the film 2 made of plastic material which intercepts, firstly, the film 2 arriving towards the lower roller conveyor 17.

The first redirecting roller 23 is supported at its longitudinal ends by two levers 24.

The levers 24 are pivoted on a base 17*a* (described in more detail below) of the lower roller conveyor 17, so as to oscillate about a respective predetermined axis A parallel to the rollers 18.

The above-mentioned first redirecting roller 23 and oscillating levers 24 define a pendulum device 25.

The device 1 also comprises members 26 for detecting the inclination of the above-mentioned oscillating levers 24.

The detection members 26 comprise a cam element 27 fixed to one of the levers 24, and a sensor 28 facing the cam element 27 and operatively connected to it so as to detect the degree of oscillation of the levers 24 relative to the above-mentioned predetermined axis A.

Figure 4:
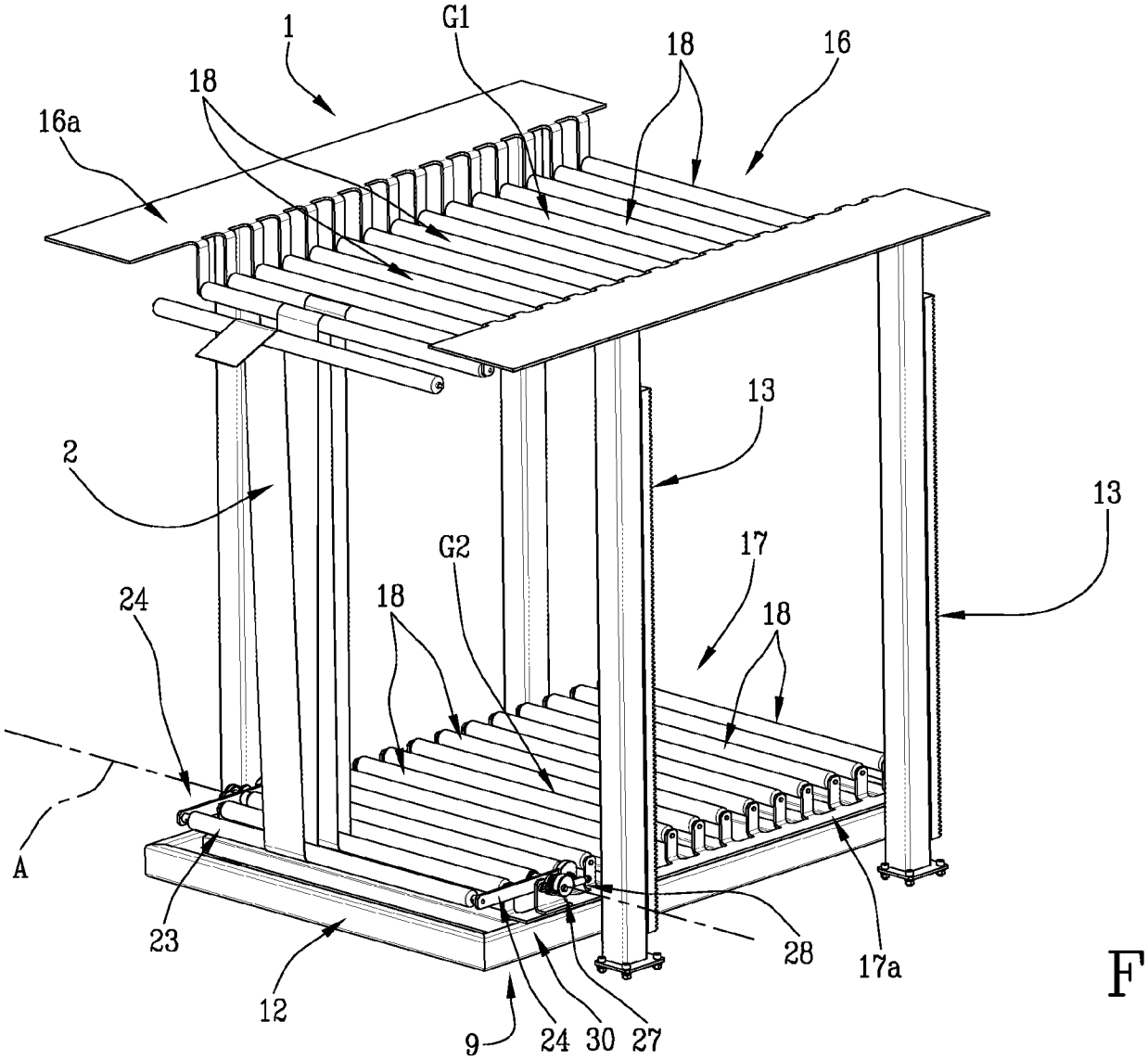
FIG. 4 is a schematic perspective view, with some parts cut away to better illustrate others, of another embodiment of the device of the preceding drawings.
Figure 5:
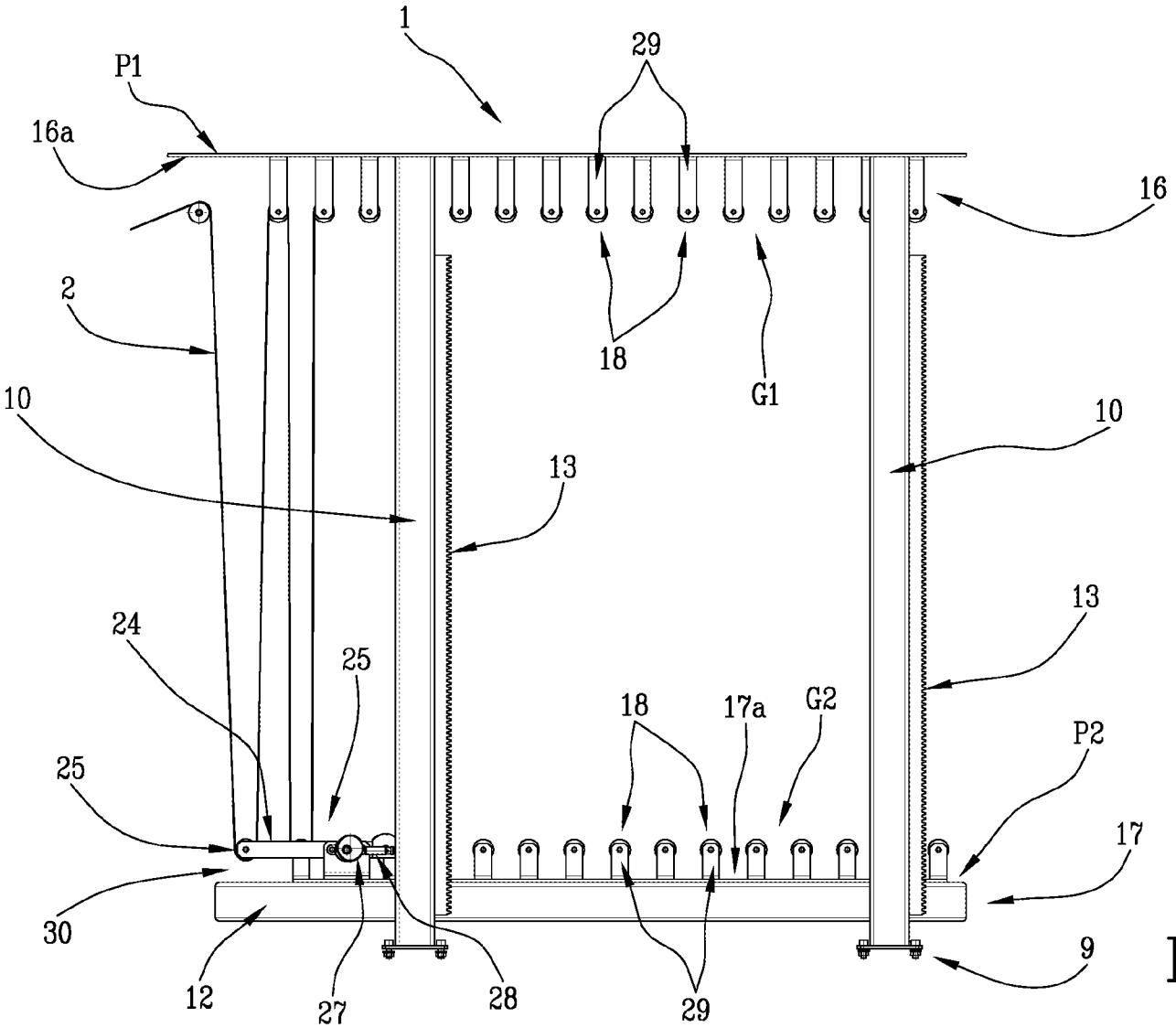
FIG. 5 is a schematic side elevation view of the device of FIG. 4.

With specific reference to the embodiment illustrated in FIGS. 4 and 5, both the upper and lower roller conveyors 16, 17 have a relative supporting base 16*a*, 17*a*.

Each supporting base 16*a*, 17*a* extends substantially on a respective predetermined plane P1, P2.

Each roller conveyor 16, 17 also has a plurality of portions 29 for rotatably supporting the respective rollers 18, the portions 29 emerging away from the respective base 29 and from the respective predetermined plane P1, P2.

More specifically, the portions 29 of the upper roller conveyor 16 project downwards whereas the portions 29 of the lower roller conveyor 17 project upwards.

In other words, the rollers 18 of each roller conveyor 16, 17, thanks to the above-mentioned supporting portions 29, extend completely outside the respective predetermined plane P1, P2.

Thanks to this technical feature just described, together with the fact that the rollers 18 of each roller conveyor 16, 17 are spaced apart from each other by a length at least greater than the diameter of the rollers 18, the two roller conveyors 16, 17, in a closest position, not illustrated, may interpenetrate each other in such a way as to facilitate the insertion between the roller conveyors 16, 17 of the film 2 made of plastic material.

In other words and with reference to FIGS. 4 and 5, the interpenetration of the roller conveyors 16, 17 means a condition of moving towards each other such as to bring the rollers 18 of the lower roller conveyor 17 interposed between the plane P1 and the rollers 18 of the upper roller conveyor 16.

By inserting, starting from this configuration, the film 2 in the space existing between the two rows of rollers 18 and moving away the two roller conveyors 16, 17 the arrangement of the film 2 illustrated schematically in FIGS. 2 and 3 is quickly achieved wherein the film 2 is wound in the form of a coil around the rollers 18 in a succession of loops.

The opportunity just described is particularly useful at the time of activating the device 1.

The above-mentioned pendulum device 25 and the means 26 for detecting the inclination of the above-mentioned oscillating levers 24 define, in their entirety, means 30 for actuating the movement means 22 which are configured to be controlled as a function of the state of tension of the film 2 made of plastic material, as described in more detail below.

In use, during normal operation of the bagging machine 4, the film 2 made of plastic material is fed to it by the device 1 by unwinding the film 2 from a reel 3.

In this mode of normal operation, the device 1 is substantially in the configuration illustrated in FIG. 2, that is to say, with the upper and lower roller conveyors 16, 17 positioned at their maximum distance from each other.

In this configuration, a length L of film 2 is stored, using the above-mentioned loops, between the rollers 18 of the two roller conveyors 16, 17, inside the device 1.

The drawing unit 14 therefore feeds the film 2 to the machine 4 unwinding it from the reel 3.

When the reel 3 is close to emptying, the device 1, by means sensor devices and signalling units of known type and not described in further detail, notify the operator, with suitable acoustic and/or luminous signals.

The operator then locks the end of the film 2 being unwound from the reel 3, cuts the film 2 at a predetermined position deemed suitable for the joining with the start end of the film 2 of a new reel (not illustrated), and splices the two above-mentioned ends of the two film 2 together.

At this point, the new reel 3 is set in the working position and can be normally unwound.

During the operations for joining the two ends of the film 2, the device 1, using the means 22 for relative movement, gradually reduces the distance between the two roller conveyors 16, 17, that is to say, the two groups G1, G2 of rollers 18, depending on the request for film 2 by the bagging machine 4, in such a way that the length L of film 2 stored is used by the bagging machine 4 without this having to undergo stoppages in its operations due to the changing of the reel 3.

The pendulum device 25 is configured in such a way as to operate as follows.

If the film 2 wound around the first redirecting roller 23 is in excess with respect to the needs of the bagging machine 4, the weight force acting on the first roller 23 (its own or due to masses connected to it) holds the lever 24 inclined downwards, taking the cam element 27 to a distance greater than the maximum reading distance of the sensor 28.

Following this, the detection carried out by the sensor 28 inhibits the dispensing of the film 2 to the bagging machine 4. Under normal operation, this is equivalent to keeping inactive the drawing unit 14 whilst during the steps for changing the reel 3 this is equivalent to keeping inactive the means 22 for relative movement of the roller conveyors 16, 17.

If, on the other hand, the quantity of film is less than the needs of the bagging machine 4, the tension of the film 2 overcomes the weight force acting on the first redirecting roller 23 and therefore the lever 24 moves horizontally rotating the cam element 27 in such a way that it is detected by the sensor 28.

When the sensor 28 detects the cam element 27, the unit 14 for drawing the film 2 is activated, in the case of normal operation, or the movement means 22, during the step of changing the reel 3, so as to bring together the roller conveyors 16, 17 and make available for the bagging machine 4 the length L of film 2 stored in the device 1.

The invention fulfils the proposed aim and achieves important advantages, guaranteeing an effective procurement of film to the user machine without requiring the stoppage of the machine during operations for changing the reel of film.

The invention claimed is:

1. A device for feeding and accumulating film made of plastic material wound on a reel on a bagging machine, comprising:

a frame, a reel mount for supporting a reel of film made of plastic material, the reel mount mounted on the frame, a first group and a second group of rollers for redirecting the film made of plastic material, the rollers of the first and second groups being positioned in two respective rows which are parallel to each other, the film being configured to be wound alternatively on the rollers of the first and second groups, thus forming a plurality of loops, an actuation device for relative actuation of the first and second groups, to vary a distance between the first and second groups of rollers and an extension of the loops, an activating device for activating the actuation device, configured to be controlled as a function of a state of tension of the film made of plastic material, wherein the activation device comprises a pendulum device having a first redirecting roller for redirecting the film made of plastic material, the pendulum device comprising two oscillating levers for supporting the first redirecting roller, the two oscillating levers being configured to oscillate around a predetermined respective axis which is parallel to the rollers of the first and second groups, detection members far detecting an inclination of the two oscillating levers, the detection members cam rising a cam element fixed to one of the two oscillating levers, and a sensor facing the cam element and operatively connected to the cam element to detect a degree of oscillation of the two oscillating levers relative to a predetermined axis.

2. The device according to claim 1, and further comprising two roller conveyors on which the rollers of the first and second groups are respectively mounted, a first of the two roller conveyors being fixed relative to the frame and a second of the two roller conveyors being movable relative to the frame, the pendulum device being supported by the movable second of the two roller conveyor.

3. The device according to claim 2, wherein the actuation device comprises an electric motor supported by the movable second of the two roller conveyors to put a plurality of gear wheels into rotation, and respective racks fixed to the frame and on which the gear wheels mesh.

4. The device according to claim 2, wherein the actuation devise comprises an electric motor supported by the frame and a plurality of lead nut and screw couplings, the motor being configured to rotate a plurality of threaded rods threadingly engaged with respective threaded holes made integral with the movable second of the two roller conveyors.

5. The device according to claim 2, wherein the rollers of each of the two roller conveyors are spaced from each other to allow at least partial penetration of the roller conveyors for insertion of the film made of plastic material between adjacent rollers.

6. The device according to claim 5, wherein at least one of the two roller conveyors comprises a supporting base which extends substantially in a predetermined plane, and a plurality of supporting portions for rotatably supporting the rollers of the at least one of the two roller conveyors, the portions protruding from the plane so as to allow the at least partial penetration of the roller conveyors.

7. The device according to claim 6, wherein the rollers supported by the supporting portions extend completely outside the predetermined plane.

8. A system for manufacturing pipes made of plastic material, comprising:

a line for feeding pieces of pipe made of plastic material, a machine for bagging one or more pieces of pipe, the device according to claim 1.

* * * * *